United States Patent [19]

Howard

[11] 4,136,587

[45] Jan. 30, 1979

[54] BREAK-JOINT POWER PISTON SCREW JACK

[76] Inventor: Julian A. Howard, Main St., New Haven, Ky. 40051

[21] Appl. No.: 851,860

[22] Filed: Nov. 16, 1977

[51] Int. Cl.[2] ..... B66F 11/00

[52] U.S. Cl. ..... 81/3 R; 254/1; 7/100

[58] Field of Search ..... 81/3 R; 254/1, 100; 29/256; 7/100

[56] References Cited

U.S. PATENT DOCUMENTS

| | | | |
|---|---|---|---|
| 2,188,838 | 1/1940 | Kimbrell | 254/100 |
| 2,872,880 | 2/1959 | Madden | 254/1 UX |
| 3,736,816 | 6/1973 | McAfee | 81/3 R |
| 3,862,743 | 1/1975 | Graafsma et al. | 254/100 |

*Primary Examiner*—Al Lawrence Smith
*Assistant Examiner*—James G. Smith
*Attorney, Agent, or Firm*—Arthur F. Robert

[57] ABSTRACT

A screw jack, for raising the power piston of a diesel engine's control governor until the power piston firmly clamps the gap gage, is provided to maintain the piston in its full load position during the adjustment of the engine fuel pump racks to match the governor piston gage, this adjustment being done when the diesel engine is shut down and the start contactors blocked open or insulated. The screw jack contains a break joint which, in its fully operative clamping position, can be rendered instantly inoperative simply by breaking the joint of the jack manually, a result effected by a single karate-like sweep of the hand.

3 Claims, 7 Drawing Figures

BREAK-JOINT POWER PISTON SCREW JACK

BACKGROUND OF THE INVENTION

1. Field of the Invention

This invention relates to the art of adjusting diesel engine fuel pump racks to match the governor's power piston gage gap. More particularly, the invention relates to an improved power piston screw jack which is used to raise the power piston sufficiently to clamp the gap gage firmly and then hold it in its clamped position during the adjustment.

2. Description of the Prior Art

In the prior practical art, multi-cylinder diesel engines, such as those having 8, 12 and 16 cylinders, all include: (1) an engine speed control governor having, internally or externally, a vertically movable power piston characterized by a gage gap in the vertical axis of the piston and by a lug integrally secured to project downwardly or depend from the piston; (2) a fuel pump for each engine cylinder, each pump having its own adjustable fuel rack; (3) a pair of long right and left horizontal fuel rack shafts, one for each side of the engine, each rack shaft extending longitudinally along its side of the engine in a vertical plane behind and in a horizontal plane spaced below the corresponding right and left series of air boxes more or less on the level of the right return air manifold; (4) a pair of right and left fuel rack linkage systems, each rack linkage system providing a series of identical trains of mechanism, one train for each fuel rack, each train connecting its fuel rack to the corresponding rack shaft; (5) a cross-over linkage connecting the right rack shaft with the left rack shaft so that when the right rack shaft is operated, the left rack shaft will be simultaneously operated; and (6) a terminal linkage system interconnecting the right rack shaft with the depending lug of the vertically movable power piston, and being characterized by a shaft-mounted overspeed link which, as the fuel feed increases, moves angularly, say upward, about the axis of its shaft and which, as it moves upwardly, raises the power piston accordingly.

When the engine is at top speed, the gage gap should equal a known or predetermined value. For the sake of clarity, we assume hereinafter that this gap equals 0.344 inches. All fuel pump racks must be adjusted to a setting which matches the 0.344 inch gage gap. In effecting this match, the power piston and the outer end of said overspeed link, which are interconnected, must be jacked up to a position simulating or corresponding to the top speed of the engine.

For jacking purposes, one conventional practice comprises: (1) place an 0.344 inch metal gage between the bottom of the governor casing and the top of the vertically-movable power piston; (2) provide a rigidly mounted base platform spaced below the outer end of the overspeed link; and (3) place a vertical screw jack upright upon the base platform and adjust its screw (a) to lengthen or extend the jack vertically into rising engagement with the bottom of the outer end of the overspeed linkage and (b) for further rising movement during which it causes the angularly moving overspeed linkage to move the power piston upwardly along its vertical center axis until the 0.344 inch gage is firmly compressed upwardly against the governor casing by the top of the power piston.

When the gap gage is firmly compressed or clamped, each fuel pump rack may then be separately adjusted to its correct millimeter setting.

After each rack has been individually adjusted and before the engine is restarted, the screw jack should be returned to its normal inoperative position and removed. Occasionally, a workman may start the diesel engine with the screw jack in its gage clamping position. When this is done, the engine will take off with a continuously rising speed. Before the adjusting screw of the jack can be sufficiently unscrewed, the engine may be seriously damaged or completely wrecked.

SUMMARY OF THE INVENTION

Objects Of The Invention

The principal object of this invention is to provide a power piston screw jack with can be more or less instantly rendered inoperative so that, if the diesel engine is started with the jack in its operative clamping position, it will be possible to render the jack inoperative before the diesel engine is damaged or wrecked.

STATEMENT OF THE INVENTION

The present invention provides the screw jack with a quick break-joint which can be rendered instantly inoperative simply by breaking the joint of the jack manually, a result effected by a single push or karate-like sweep of the hand.

BRIEF DESCRIPTION OF THE DRAWINGS

An embodiment of the invention is illustrated in the accompanying drawing wherein.

DESCRIPTION OF THE PREFERRED EMBODIMENT

Figure 1:
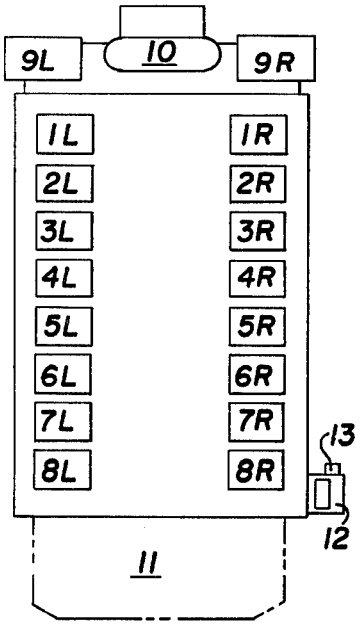
FIG. 1 is a schematic overhead view of a conventional diesel engine.

FIG. 1 indicates a 16 cylinder diesel engine having a left bank of cylinders designated 1L through 8L, a right bank of cylinders designated 1R through 8R, left and right intercoolers 9L and 9R, flanking the respective left and right sides of a centrally disposed turbocharger 10 at the free end of the engine, a traction generator 11 at the opposite or generator end of the engine and, on the right side of the engine near its generator end, an engine control governor 12 and an overspeed governor 13.

Figure 2:
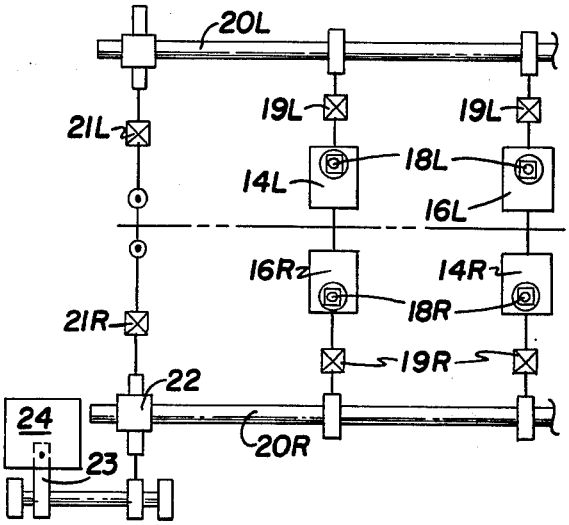
FIG. 2 is a schematic view of a fragmentary portion of the linkage system extending on each side of the diesel engine, between the adjustable fuel rack of each fuel pump and the governor including the cross-over linkage between the right and left linkage systems.
Figure 3:
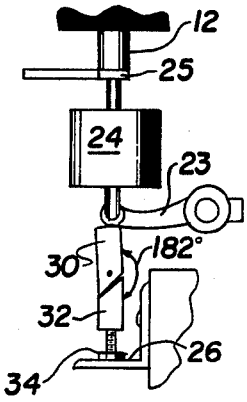
FIG. 3 is an end elevational view showing the relationship between the gap gage, the power piston, the overspeed link and a break-joint jack embodying my invention when the jack is in its operative gage clamping position.
Figure 4:
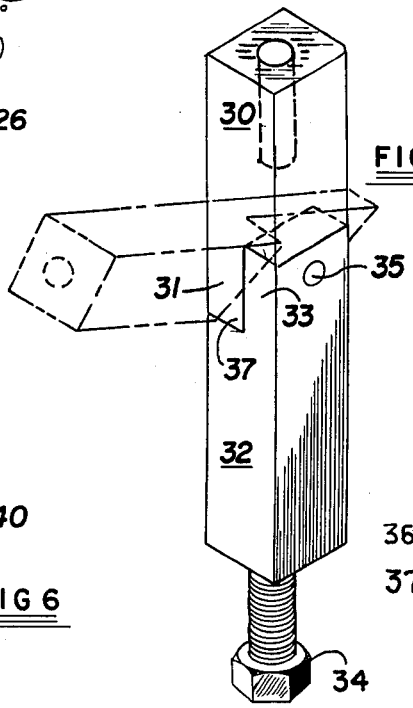
FIGS. 4 and 5 are enlarged perspective views looking at opposite sides of the jack and showing the locked jack of FIG. 3 in solid lines and the broken jack in dotted lines, FIG. 5 also showing the gage conveniently connected to the jack by a chain.
Figure 5:
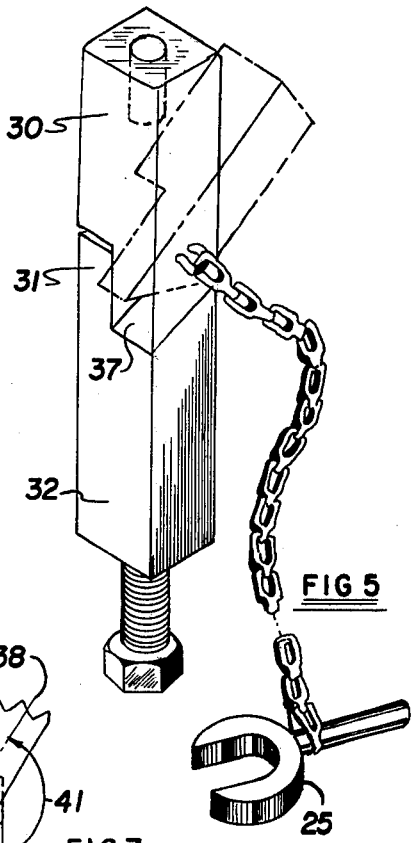
Figure 6:
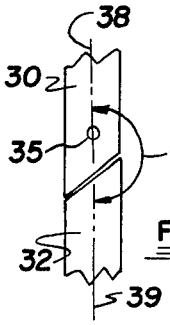
FIGS. 6 and 7 are schematic views of the locked jack and broken jack, respectively, these views showing the relationship between their respective longitudinal planes.
Figure 7:
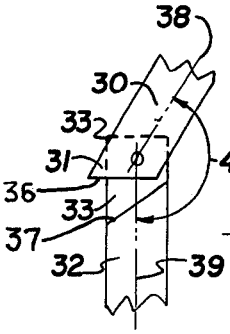

FIG. 2 indicates: a left bank of fuel pumps 14L and 16L for left bank cylinders 7L and 8L, each having an adjustable fuel pump rack 18L; a right bank of fuel pumps 14R and 16R for right bank cylinders 7R and 8R, each having an adjustable fuel pump rack 18R; a pair of left and right fuel linkage systems including one series of left trains of mechanism 19L and another series of right mechanism trains 19R; left and right fuel rack shafts 20L and 20R; a cross-over linkage, composed of identical left and right halves 21L and 21R connected to each other in series and arranged to connect the left fuel rack shaft 20L to the right fuel rack shaft 20R at a common intersection point 22 on shaft 20R; and a terminal linkage system, provided only on the right side of the engine, to extend between fuel rack shafts 20L and 20R on the one hand and the power piston 24 of the engine control governor 12 on the other hand and arranged to connect both of those fuel rack shafts through their common interconnection point 22 to an overspeed link 23 which is operatively associated with the power piston 24 of the engine control governor 12.

With the diesel engine shut down and the start contactors (not shown) blocked open or insulated, the engine fuel pump racks 18L and 18R must match the governor piston gap which is located in the vertical axis of the power piston 24 usually between the bottom of the engine control governor 12 and the top of the power piston 24. To determine if a given fuel pump rack matches the governor piston gap and to effect the proper adjustment where a mismatch is encountered, a piston gap gage 25, marked for a full load piston gap, is inserted in the gap. As stated before, gage 25 is assumed to be an 0.344 inch metal gage.

With the gage in place, the overspeed link 23 is turned angularly upward to and held in a position wherein the gap gage 25 is firmly compressed or clamped between the bottom of the engine control governor 12 and the top of the power piston 24. Now, each of the individual pump racks 18L and 18R is inspected to determine if its millimeter travel position reads as required by the fuel load fuel setting. Those fuel racks which are correctly positioned need no adjustment. Each incorrectly positioned fuel pump rack 18L and 18R is conventionally unlocked, disengaged, screwed inwardly or outwardly to the proper millimeter travel position and then re-engaged and locked.

During these individual adjustments, the piston gap gage 25 is continuously maintained in its compressed or clamped condition by means of a screw jack arranged between the bottom side of the overspeed link 23 and a rigidly but removably mounted base platform 26 with the top of the jack engaging the link 23 and the lower head-end of the jack's adjusting screw engaging the base platform 26. After all adjustments have been made, the adjusting screw of the jack is turned to reduce the overall length of the assembly to a point where both the screw jack and the gap gage can be removed.

Occasionally, the removal of the gage and the screw jack is overlooked. As a consequence, the engine control governor 12 is held in its wide open throttle position while its overspeed governor 13 is held inoperative. Now, if the engine is started, it will take off and may increase in speed too rapidly to permit the screw of the screw jack to be unscrewed sufficiently to enable the screw jack to be removed in time to prevent damage to and possibly the wrecking of the diesel engine.

In accordance with my invention, a metal break-joint screw jack is provided which operates in all respects like the conventional screw jack except that it can be instantly rendered inoperative simply by breaking the joint of the jack manually through a simple push or karate-like sweep of the hand.

In specific terms, the preferred form of my screw jack comprises: a longitudinally extending upper part 30 having a lower end portion 31 of reduced thickness; a similarly extending lower part 32 having an upper end portion 33 of reduced thickness arranged to overlap the reduced lower end portion of the upper part; an adjusting flat-headed screw 34 threaded into the free or bottom end face of the lower part 31; and a transverse pivot 35 securing the overlapped end portions 31, 33 of the two parts pivotally together for angular movement back and forth between operative and inoperative positions on opposite sides of their dead center position, wherein their respective pivot-intersecting long axes are aligned with each other so that they cooperate to form an angle of 180° between them.

In the operative position, which is self-locking, the long pivot-intersecting axes of the parts cooperate to form one angle slightly less than 180° (say 178°) on one side and another angle correspondingly greater than 180° (say 182°) on the opposite side. For convenience and clarity, the opposite sides of the jack, which respectively correspond to the 180° minus and 180° plus angles of said long axes, are hereinafter called the locking side and the striking side, respectively. To stop the parts when they reach the self-locking position, the lowermost end face 36 of the reduced end portion 31 of upper part 30 is arranged, preferably sloped, to engage the corresponding, preferably sloped, end face 37 of the unreduced portion of the lower part 32 and, through such engagement, prevent continuing movement beyond the self-locking position.

My screw jack is used in the same way as a conventional screw jack. After all racks are correctly set, the jack and gage are removed and the start contactors cleared for operation. However, if the diesel engine is started while the jack and gage remain in place, then the engine speed will start to rise rapidly. Before it can rise to a dangerously high value, the joint of my jack can be broken and the jack removed quickly and more or less instanteously simply by hand-striking or pushing the strike side of the jack. The force used in breaking the joint need be no more than slight; hence, the magnitude of the force required is not a problem. As soon as the joint is broken, the governor 12 will take over the speed control of the engine.

In further accordance with my invention, the removably mounted base platform 26 is arranged so that it may be mounted one way, as shown in this case wherein the platform is at the lower end of its securing sidewall, or reversed in another case so that the platform is at the upper end of the securing sidewall. This will facilitate the use of the jack on diesel engines of different makes. Also, for convenience and safekeeping purposes, the gap gage 25 preferably is secured to the screw jack by means of a long chain 38.

From the foregoing, it will be appreciated that I have provided a lengthwise adjustable jack for use between a stationary base 26 and the overspeed link 23 of a diesel engine to raise the power piston 24 of the engine's control governor 12 to, and hold it in, its full load position during the adjustment required to match the fuel pump racks 18L and R with the governor's piston gap, comprising: A. a longitudinally elongate body having 1. opposite sides, including a strike side, 2. an upper part 30 having an upper end engagable with said link 23, 3. a lower part 32 having a lower end engagable with said base 26, 4. a transverse pivot 35 (a) hinging the parts 30, 32 pivotally for angular movement back and forth between (i) a locked joint position, wherein their longitudinal planes 38, 39, which extend through the longitudinal center axis of the pivot 35, point in one direction and cooperate to form, on the strike side of said body, a fixed angle 40 slightly greater than 180°, and (ii) a broken joint position, wherein said planes 38, 39 point in the opposite direction and cooperate to form on the strike side of said body, another angle 41 less than 180°; and B. means (screw 34) on said body for adjusting the length of said body.

While the body lengthening or adjusting means, preferably, is in the conventional form of the flat-headed screw 34 shown, any suitable means for adjusting the length of the body may be employed. For example, the lower part 32 or the upper part 30 may be composed of two longitudinally separated sections, the adjacent ends of which are longitudinally spaced to receive an interposed adjusting nut having threaded stems at its opposite ends, and formed with threaded holes to receive the threaded stems of said nut. The upper part 30 has a hole in its upper end face to receive the grease fitting (not shown) normally provided on the overspeed link 23.

Having described my invention, I claim:

1. A lengthwise adjustable jack for use between a stationary base and the overspeed link of a diesel engine to raise the power piston of the engine's control governor to and hold it in its full load position during the adjustments required to match the fuel pump racks with the governor's piston gage gap, comprising:

A. a longitudinally elongate body having
  1. opposite sides, including a strike side,
  2. an upper part having an upper end engagable with said link,
  3. a lower part having a lower end engagable with said base,
  4. a transverse pivot
    a. hinging the parts pivotally for angular movement back and forth between
      i. a locked joint position, wherein their longitudinal planes, which extend through the longitudinal center axis of the pivot, point in one direction and cooperate to form, on the strike side of said body, a fixed angle slightly greater than 180°; and
      ii. a broken joint position, wherein said planes point in the opposite direction and cooperate to form, on the strike side of said body, another angle less than 180°, B. means on said body for adjusting the length of said body.

2. The jack of claim 1 wherein:

A. said parts are arranged to engage each other in the locking position and, through such engagement, prevent further angular movement of the parts in a direction increasing said fixed angle on the strike side.

3. The jack of claim 1 including:

A. a piston gap gage; and

B. a chain connecting said gage to said body.

* * * * *